United States Patent [19]

Mueller

[11] Patent Number: 4,648,847

[45] Date of Patent: Mar. 10, 1987

[54] ADJUSTING MECHANISM FOR VARIABLE PITCH WATERCRAFT PROPELLERS

[76] Inventor: Peter Mueller, Widmerstrasse 27, Zürich, Switzerland

[21] Appl. No.: 711,161

[22] Filed: Mar. 13, 1985

[30] Foreign Application Priority Data

Mar. 16, 1984 [CH] Switzerland ..... 1354/84

[51] Int. Cl.[4] ..... B63H 3/08

[52] U.S. Cl. ..... 440/50; 416/159; 416/166

[58] Field of Search ..... 440/50, 51, 900; 416/159, 162, 166

[56] References Cited

U.S. PATENT DOCUMENTS 2,742,097 4/1956 Gaston ..... 440/50 X
2,931,443 4/1960 Pehrsson ..... 170/160
3,095,932 7/1963 Hercules ..... 416/166

*Primary Examiner*—Sherman D. Basinger
*Assistant Examiner*—Paul E. Salmon
*Attorney, Agent, or Firm*—Helfgott & Karas

[57] ABSTRACT

A mechanical linkage for adjusting propeller blades includes a two-armed lever arranged on the downstream side of the hub of a variable pitch propeller driven by a driving engine by means of a drive shaft. The push rod of a linear motor connected to an energy source moves one arm of said adjusting lever. The other arm of the adjusting lever is articulated to a non-rotatable adjusting sleeve which is coupled via a thrust bearing to a rotary intermediate adjusting member. Adjusting rods are fixed to the intermediate adjusting member and are guided in the hub and accomplish the adjustment of the propeller blades.

3 Claims, 4 Drawing Figures

ADJUSTING MECHANISM FOR VARIABLE PITCH WATERCRAFT PROPELLERS

SPECIFICATION

This invention relates to an adjusting mechanism for setting the pitch of propeller blades rotatably mounted in the hub of a variable pitch watercraft propeller, the adjusting mechanism being operable to alter the position of a non-rotating adjusting member on the outflow or downstream side of the propeller hub.

BACKGROUND OF THE INVENTION

Adjusting mechanisms for setting the pitch of a variable pitch propeller blade, or a set of such blades, are known in various structural forms. On the one hand, such mechanisms serve to more efficiently utilize the power produced by an engine installed in a watercraft and, on the other hand, they also serve to facilitate maneuvering of the craft. The pitch of the propeller blades can be set manually or automatically as a function of the intended use and it is also possible to set the propeller blades for moving the watercraft backwards, i.e., for running astern.

The variable pitch propeller assembly is rotated by a shaft driven by a motor drive which is commonly housed within the watercraft, but the pitch of the propeller blades is adjusted in a different way. It is known, for example, to introduce a hydraulic fluid into the propeller hub to act on a piston system arranged in the hub so that the propeller blades are adjusted as shown in U.S. Pat. No. 2,931,443.

It is also known to adjust the propeller blades by means of a mechanical linkage or gear with the adjusting force being manually applied. For this purpose, the adjusting movement is transferred to an adjusting member mounted in a non-rotational manner in the propeller hub and the movement is transferred from that member through a thrust bearing to a rotary adjusting member which performs the propeller blade adjustment movement by means of a linkage as shown in U.S. Pat. No. 2,742,097.

Both types of adjusting mechanisms suffer from disadvantages. Thus, the propeller blade adjustment which is accomplished by introducing a pressure medium into the propeller hub is complicated, which means that it is only usable for larger watercraft, and it is also difficult to completely seal the pressure system. The manually actuated adjusting mechanism has the disadvantage that it can only be used in small variable pitch propellers because it is simply not possible to manually apply forces sufficiently large to adjust the propellers in the case of larger propeller assemblies.

SUMMARY OF THE INVENTION

An object of the present invention is to provide an adjusting mechanism which is simple and which simultaneously makes it possible to apply large adjusting forces so that it can be used with large adjustable propeller assemblies.

Briefly described, the invention includes an adjusting mechanism for setting the pitch of propeller blades rotatably mounted on the hub of a variable pitch watercraft propeller comprising the combination of a non-rotatable adjusting member mounted for generally linear movement on the downstream side of the hub, the adjusting member being coupled to an intermediate rotatable member coupled to the blades. An adjusting linkage is connected at one end to the adjusting member, and a linear motor which is mounted in spaced relationship from the variable pitch propellers is connected to the other end of the linkage so that linear motion of the motor sets the propeller pitch.

The adjusting mechanism disclosed herein can be used in a watercraft in such a way that the linear motor can be positioned either inside or outside the watercraft hull.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification, and wherein.

DESCRIPTION OF THE PREFERRED EMBODIMENTS

Figure 1:
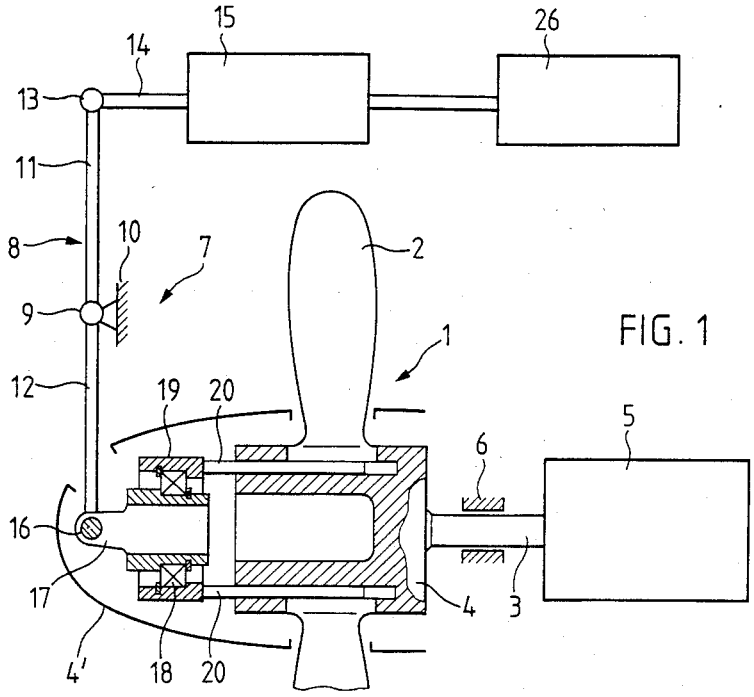
FIG. 1 is a partly schematic side elevation of an adjustable pitch propeller assembly with an adjusting mechanism in accordance with the invention for setting the propeller blade pitch.

FIG. 1 schematically shows a propeller assembly indicated generally at 1 with adjustable propeller blades 2 mounted on a propeller hub 4 which is rotatably driven by a shaft 3 driven, in turn, by an engine 5. Shaft 3 is mounted in a journal or bearing 6, and the engine is, normally, mounted within the hull of a watercraft, not shown in FIG. 1. Each of propellers 2 is mounted for limited rotation about its own axis, which is generally perpendicular to the axis of hub 4. The adjustment of the pitch of the propeller blades essentially takes place through a mechanical linkage indicated generally at 7, a main portion of the linkage being a two-armed adjusting lever 8 which is pivotally supported on a pivot pin 9 which is, in turn, supported in a support bearing 10. Bearing 10 is either mounted on the watercraft or, if the propeller assembly 1 forms part of a pivotable rudder arrangement, the step bearing can be mounted on the rudder itself.

Adjusting lever 8 has an upper arm 11 and a lower arm 12, the upper arm being coupled by a flexible, hinge joint 13 to the push rod 14 of a linear motor 15 which is driven by a power or energy source 26. Lower arm 12 is connected by a pivotable joint 16 to a non-rotatable adjusting member 17. By "non-rotatable" it is meant that member 17 does not rotate about the axis of shaft 3 and hub 4. Member 17 can be constructed in various ways. In one form, as illustrated, member 17 comprises a ring or sleeve which carries a journal bearing 18 the outer portion of which is mounted in a rotatable intermediate adjusting member 19 which is an annular sleeve surrounding member 17. Adjusting rods 20 are connected to member 19 and are guided in elongated holes in hub 4 and are coupled to propeller blade 2, as by gear teeth or the like, so that longitudinal movement of rods 20 causes rotation of propellers 2 about their own axes, thereby adjusting the pitch of the propellers. As a result of this arrangement, the movement is transferred from the non-rotatable adjusting member 17 to the rotatable intermediate adjusting member 19 in a simple and space-saving manner. Although pivotable joint 16 is mounted on adjusting member 17, that member can be housed together with the joint 16 and without occupying additional space in a lightweight, streamlined cowling 4', schematically shown in FIG. 1, which surrounds hub 4.

This arrangement is applied to a watercraft in the illustration of FIG. 2 in which the variable pitch propeller assembly 1 which is driven by shaft 3 is arranged in a fixed manner below the hull 25 of a watercraft and a hollow supporting body 21 is attached to the hull and supports, at its lower end, the propeller assembly. A rudder 22 is hingedly mounted on the rear portion of supporting body 21 by hinges 24 and the mechanical linkage 7 is installed within supporting body 21. The reference numerals which are not specifically mentioned in this description indicate devices which are the same as described in connection with FIG. 1.

Figure 2:
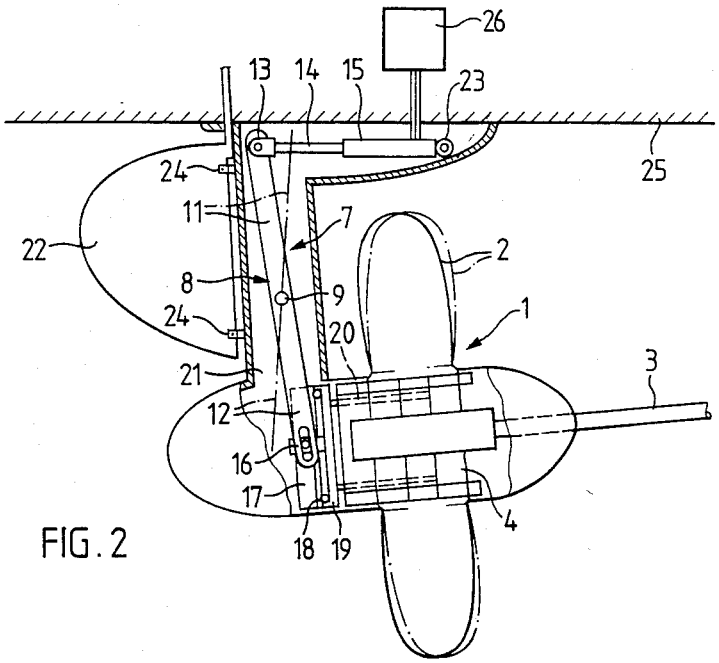
FIG. 2 is a side elevation of a variable pitch propeller adjusting mechanism in accordance with the invention and employing the principles of FIG. 1.

In the apparatus of FIG. 2, linear motor 15 is a double-acting (bidirectional) hydraulic piston and cylinder assembly the piston rod of which forms the push rod 14, the motor 15 being supported on a pivot joint 23 within supporting body 21. A hydraulic unit 26, such as a pump, supplies pressure medium for the operation of the adjusting mechanism and is used for driving linear motor 15. Motor 15, which could alternatively be an electrical or pneumatic unit, is mounted below the hull 25 within body 21 in the arrangement of FIG. 2, but it is also possible to construct the upper arm 11 of lever 8 in such a way that it projects through the hull and into the watercraft so that motor 15 can be positioned within hull 25. Because the mechanical linkage for the transfer of the adjusting forces is within propeller hub 4 while the linear motor 15, which is spaced from the hub, produces the energy required for overcoming the adjusting resistive forces, an uncomplicated, space-saving solution adapted to various space conditions results.

Figure 4:
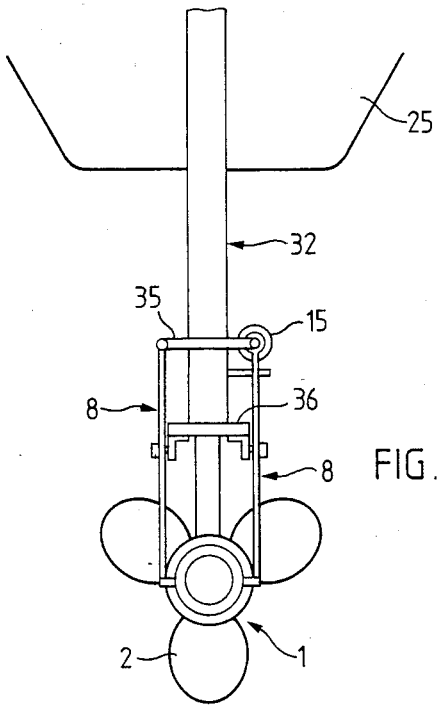
FIG. 4 is a rear view of the apparatus of FIG. 3 in the direction of arrow IV.
Figure 3:
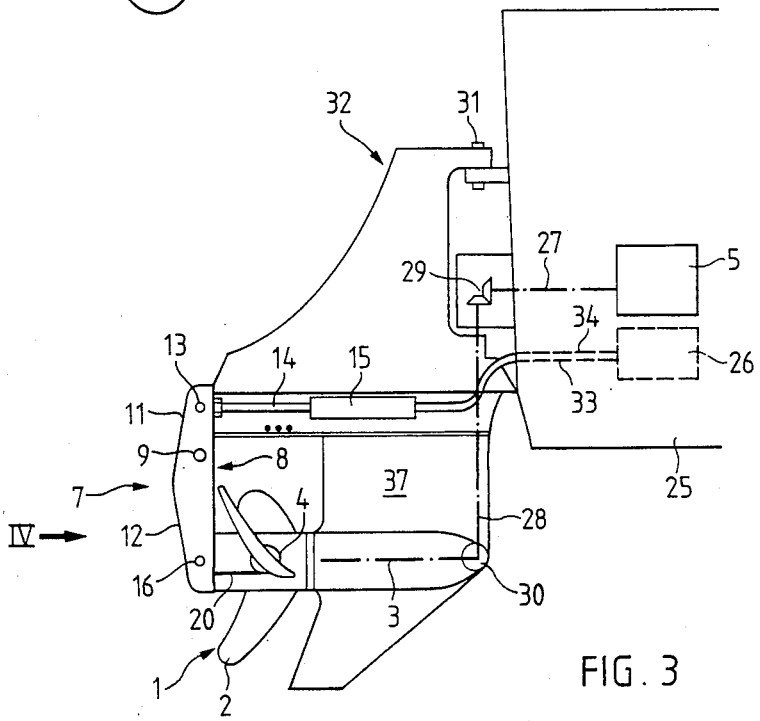
FIG. 3 is a side elevation of a further embodiment of a watercraft with an adjustable propeller assembly and an adjustment mechanism in accordance with the invention in conjunction with a rudder assembly.

FIGS. 3 and 4 show an adjusting mechanism for adjusting the propeller blades 2 of a variable pitch propeller assembly 1 which have a power train of the type known as a Z-drive in which the drive shaft 3 differs from the sloping arrangement through the watercraft hull 25 which is illustrated in connection with FIG. 2. In the arrangement of FIG. 3, drive shaft 3 is driven by engine 5 via shafts 27 and 28 which are coupled together by bevel gears 29 and 30, the shafts 3, 27 and 28 being arranged in a generally Z-shaped manner. The two bevel gears 29 and 30 and shafts 3, 28 are housed in a rudder assembly 32 which is articulated to hull 25 as a pivotable part by means of hinges 31, only one of which is visible in FIG. 3. The complete adjusting mechanism is housed in rudder assembly 32 and linear motor 15 with push rod 14 and the mechanical linkage 7 can be seen. The reference numerals which are not specifically described at this point are the same as those referred to in FIGS. 1 and 2.

In FIG. 3, linear motor 15 is again a double-acting hydraulic piston and cylinder arrangement which is connected by hydraulic lines 33, 34 to a power or energy source 26 which is constructed as a hydraulic source unit.

FIG. 4 shows more clearly that linear motor 15 is positioned on an outer wall of rudder arrangement 32, the mechanical linkage comprising two adjusting levers 8 which are parallel and are interconnected by crossbars 35 and 36. The double adjusting lever 8 has the same function as a single adjusting lever. Such an arrangement can be provided with linear motor 15 being positioned within the rudder assembly 32. With its drive shaft 3, the variable pitch propeller 1 forms part of the rudder 37 itself. In this arrangement, as before, the outflow or downstream side of the variable pitch propeller assembly 1 is free for arranging the mechanical linkage 7. Thus, in its entirety, the adjusting mechanism is part of the rudder assembly 32 and is also moved with actuating rudder 37. Because the energy source 26 is appropriately housed within the hull 25 of the watercraft, the energy transfer lines 33, 34 must be arranged in a resilient or articulated manner. The structure according to FIG. 3 also leads to a technically sound and inexpensive solution as a result of the combination of a mechanical linkage for introducing the adjusting force into the propeller hub and of a linear motor, arranged in spaced relationship with respect to the propeller assembly axis, so that the positioning of the linear motor is substantially indepenent of the arrangement and positioning of the propeller assembly.

As a result of the disclosed adjusting mechanism with the arrangement of the linear motor outside of the area of the variable pitch propeller assembly and the space-saving adjusting means on the downstream side of the propeller assembly for adjusting the propeller blades 2, hub 4 can be made very small so that the mass of a variable pitch propeller assembly in accordance with the invention is close to that of a comparable propeller with fixed blades.

Furthermore, as a result of this arrangement, if linear motor 15 fails it is possible to take manual action and to position the adjusting linkage 7 in such a position that propeller blades 2 have an appropriate pitch so that the watercraft can still be maneuvered without difficulty.

While certain advantageous embodiments have been chosen to illustrate the invention it will be understood by those skilled in the art that various changes and modifications can be made therein without departing from the scope of the invention as defined in the appended claims.

What is claimed is:

1. A watercraft including an adjusting mechanism for setting the pitch of propeller blades rotatably mounted on the hub of a variable pitch watercraft propeller comprising the combination of a hollow supporting body fixedly attached to the hull of said watercraft;

a rudder pivotably mounted on the downstream side of said supporting body, a non-rotatable adjusting member mounted for generally linear movement on the downstream side of said hub, said adjustng member being coupled to an intermediate rotatable member coupled to said blades;

an adjusting linkage connected at one end to said adjusting member; and a linear motor comprising a double-acting hydraulic piston and cylinder assembly mounted outside the hull of said watercraft in said body in spaced relationship from said watercraft propeller, said adjusting linkage comprising a two-armed pivotable adjusting lever with one arm thereof acting on said non-rotatable adjusting member and the other arm acted on by said linear motor, said motor being connected to the other end of said linkage so that linear motion of said motor sets the propeller pitch.

2. A watercraft according to claim 1 and including a pivot pin for said adjusting lever mounted in said hollow body, said adjusting lever being contained within said body.

3. A watercraft having an adjusting mechanism for setting the pitch of propeller blades rotatably mounted on the hub of a variable pitch watercraft propeller on a watercraft of the type having a propulsion engine within a hull, comprising the combination of a rudder pivotably mounted on the hull of said watercraft;

a non-rotatable adjusting member mounted for generally linear movement on the downstream side of said hub, said adjusting member being coupled to an intermediate rotatable member coupled to said blades;

an adjusting linkage connected at one end to said adjusting member; and a linear motor mounted on said rudder in spaced relationship from said variable pitch watercraft propeller, said motor being connected to the other end of said linkage so that linear motion of said motor sets the propeller pitch, said linear motor comprising a double-acting hydraulic piston and cylinder assembly, said adjusting linkage comprisng a two-armed pivotable adjusting lever with one arm thereof acting on said non-rotatable adjusting member and the other arm acted on by said linear motor, and a pivot pin for said adjusting lever mounted on said rudder.

* * * * *